US005334069A

United States Patent [19]

Liu, Dexter C.

[11] Patent Number: 5,334,069

[45] Date of Patent: Aug. 2, 1994

[54] ACTION CHARACTER FIGURE WITH SPARKING MECHANISM

[75] Inventor: Liu, Dexter C., Portsmouth, R.I.

[73] Assignee: Liu Concept Design & Associates, Newport, R.I.

[21] Appl. No.: 24,248

[22] Filed: Mar. 1, 1993

[51] Int. Cl.[5] ..... A63H 3/00; A63H 33/36

[52] U.S. Cl. ..... 446/23; 446/268; 446/353

[58] Field of Search ..... 446/22, 23, 268, 398, 446/334, 340, 354; 431/125, 126; 362/808; D27/141-161

[56] References Cited

U.S. PATENT DOCUMENTS

| | | | |
|---|---|---|---|
| 1,170,311 | 2/1916 | Miller | 446/23 |
| 1,422,075 | 7/1922 | Aronson . | |
| 1,551,231 | 8/1925 | Aronson | 446/23 |
| 1,692,148 | 11/1928 | Arnold . | |
| 1,789,800 | 7/1928 | Arnold . | |
| 1,918,122 | 2/1933 | Naue | 446/23 |
| 1,938,129 | 2/1931 | Arnold . | |
| 1,950,698 | 9/1932 | Sharran et al. | 446/23 |
| 2,198,234 | 4/1940 | Stratton | 446/23 |
| 4,182,075 | 1/1980 | James | 446/298 |
| 4,721,489 | 1/1988 | Galoob | 446/23 |
| 4,842,564 | 6/1989 | Gerold et al. | 446/398 |
| 5,071,387 | 12/1991 | Pottick | 446/268 |
| 5,087,219 | 2/1992 | Price | 446/334 |
| 5,118,319 | 6/1992 | Smith et al. | 446/268 |

*Primary Examiner*—Robert A. Hafer
*Assistant Examiner*—Michael O'Neill
*Attorney, Agent, or Firm*—Salter, Michaelson & Benson

[57] ABSTRACT

An action character figure comprises a character figure body including a torso portion having a window therein and a sparking mechanism in the torso portion. The sparking mechanism is operable for producing sparks which are visible through the window by pivoting an arm on the torso portion forwardly and downwardly from an upwardly extending first position to a downwardly extending second position.

7 Claims, 3 Drawing Sheets

ACTION CHARACTER FIGURE WITH SPARKING MECHANISM

BACKGROUND AND SUMMARY OF THE INVENTION

The instant invention relates to action character figures and more particularly to an action character figure containing a sparking mechanism which is actuated by manipulating a limb on the character figure.

Various types of action character figures which are capable of performing a wide range of various different action movements have been heretofore available. However, it has generally been found that action character figures which are operative with unique and interesting forms of action movements have increased levels of appeal. Further, it has been found that interesting and amusing character figures which are capable of being incorporated into interesting and exciting play themes frequently have even greater levels of appeal.

The instant invention provides a highly amusing action character figure which is operative with a novel and amusing form of action movement and which is adapted to be incorporated into exciting and interesting play themes. Specifically, the instant invention provides an action character figure comprising a character figure body which includes a torso portion and a plurality of limbs on the torso portion, and a sparking mechanism in the torso portion. The torso portion has an aperture formed therein, and the sparking mechanism is operative in response to movement of one of the limbs from a first position thereof to a second position thereof for producing sparks which are visible through the aperture in the torso portion. The limb preferably comprises an arm which is rotatable from an upwardly extending first position to a downwardly extending second position for causing the sparking mechanism to produce sparks which are visible through the aperture. The aperture is preferably located in the chest area of the torso, portion, and the character figure preferably includes a translucent window in the aperture. Further, the sparking mechanism is preferably adapted so that it is operative for producing sparks when the arm is pivoted forwardly and downwardly from the first position thereof to the second position thereof. Specifically, the sparking mechanism is adapted so that it is initially moved to a loaded position as the arm is pivoted forwardly and downwardly from the first position toward the second position, and so that the sparking mechanism is thereafter released to produce sparks as the arm approaches the second position.

It has been found that the action character figure of the instant invention has significant play value and that it can be effectively incorporated in a wide range of amusing play themes. Specifically, it has been found that the action character figure has significant play value as a result of being operative for producing sparks which are visible through the window in the chest portion of the character figure when the character figure's arm is pivoted downwardly from the upwardly extending first position thereof to the downwardly extending second position thereof. Hence, the action character figure can be effectively cast as a exciting warrior or similar character which has exciting and supernatural powers which enable it to produce sparks for illuminating the window in the chest portion during game play.

Action character figures and similar devices representing the closest prior art to the subject invention of which the applicant is aware are disclosed in the U.S. patents to Miller U.S. Pat. No. 1,170,311; Aronson U.S. Pat. No. 1,551,231; Arnold U.S. Pat. No. 1,692,148; Aronson U.S. Pat. No. 1,422,075; Arnold U.S. Pat. No. 1,789,800; Sharran et al U.S. Pat. No. 1,950,698; Arnold U.S. Pat. No. 1,938,129; Naue U.S. Pat. No. 1,918,122; Stratton U.S. Pat. No. 2,198,234; and Galoob U.S. Pat. No. 4,721,489. However, since these references fail to suggest an amusing action character figure which is operative for illuminating a window in the chest cavity thereof by manipulating one of the limbs on the character figure they are believed to be of only general interest with respect to the subject invention.

Accordingly, it is a primary object of the instant invention to provide an effective action character figure which is operative with a novel and amusing form of action movement for producing sparks from the chest cavity thereof.

Another object of the instant invention is to provide an amusing action character figure which has a window in the chest cavity thereof, and which is capable of producing sparks which illuminate the window in the chest cavity when a limb on the character figure is manipulated.

A still further object of the instant invention is to provide an amusing action character figure having an arm which is pivotable from an upwardly extending first position to a downwardly extending second position for producing sparks which are visible through a window in the chest cavity thereof.

DESCRIPTION OF THE DRAWINGS

In the drawings which illustrate the best mode presently contemplated for carrying out the present invention.

DESCRIPTION OF THE INVENTION

Figure 1:
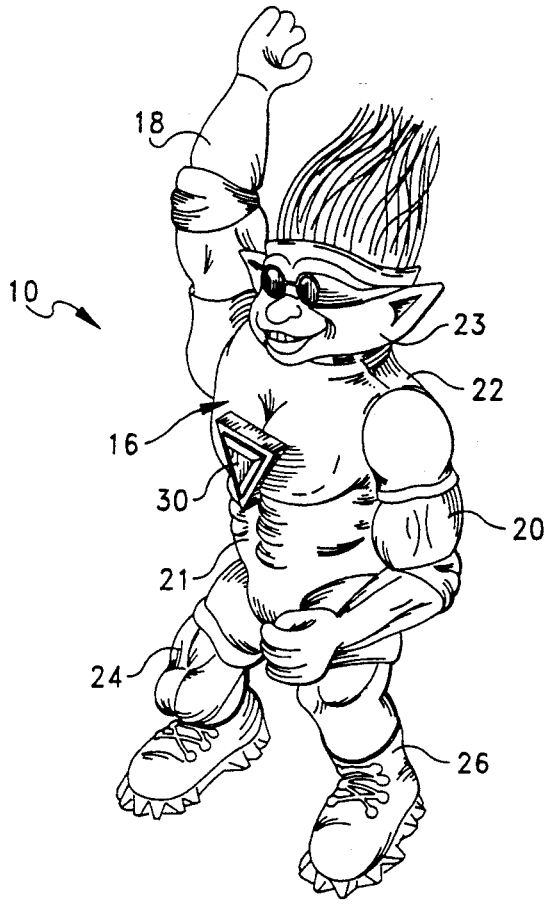
FIG. 1 is a perspective view of the action character figure with the right arm thereof in the first position.
Figure 2:
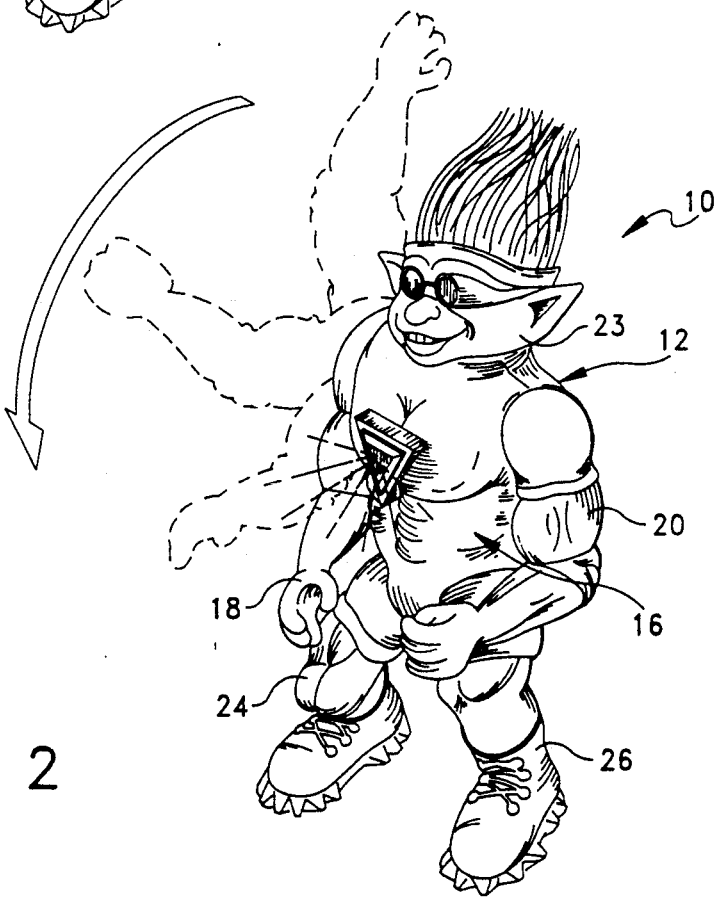
FIG. 2 is a similar perspective view illustrating the operation of the character figure for producing sparks.

Referring now to the drawings, the action character figure of the instant invention is illustrated in FIGS. 1 through 5 and generally indicated at 10 in FIGS. 1 and 2. The action character FIG. 10 comprises a character figure body portion generally indicated at 12 and a sparking mechanism generally indicated at 14 which is contained within the body portion 12. The body portion 12 includes a torso portion generally indicated at 16 having right and left arms 18 and 20 thereon. As illustrated in FIGS. 1 and 2, the action character FIG. 10 is operable for producing sparks with the sparking mechanism 14 by pivoting the right arm 18 forwardly and downwardly from the upwardly extending first position illustrated in FIG. 1 to the downwardly extending second position illustrated in FIG. 2.

The character figure body portion 12 comprises the torso portion 16 which is defined by front and rear halves 21 and 22, the right and left arms 18 and 20, respectively, a head portion 23 and right and left legs 24 and 26. The front and rear halves 21 and 22 cooperate to define a chest cavity of the character FIG. 10, and the front half 21 has an aperture 28 formed therein which contains a translucent window 30. The rear torso portion 22 includes an integrally formed mounting frame 32 and a pair of mounting posts 34 for receiving and mounting the sparking mechanism 14 in the torso portion 16. Also integrally formed in the rear half 22 is a cam wall 36 which is operative for triggering the actuation of the sparking mechanism 14 as will hereinafter be more fully set forth. The right and left arm portions 18 and 20 are pivotally mounted on the torso portion 16 in a conventional manner with reduced shaft portions 38 and enlarged disc portions 40. The right arm portion 18 further includes an actuator shaft portion 42 of substantially square cross section which is mechanically connected to the sparking mechanism 14 as will also hereinafter be more fully set forth. The leg portions 24 and 26 are pivotally mounted on the torso portion 16 in a conventional manner. The head portion 23 is preferably made of a slightly resilient plastic material, and it is rotatably received on a neck 44 as defined by the halves 21 and 22.

Figure 3:
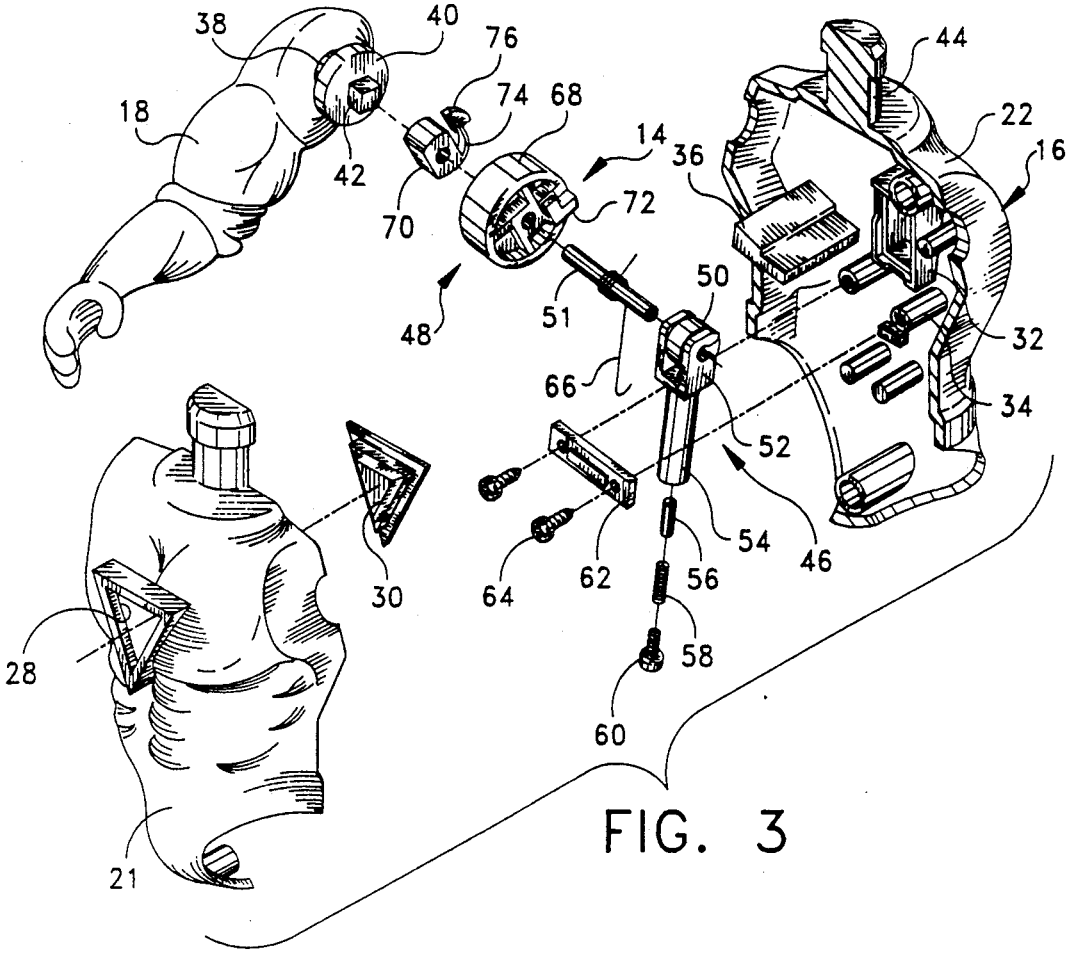
FIG. 3 is an exploded perspective view of the torso portion, right arm and sparking mechanism.
Figure 4:
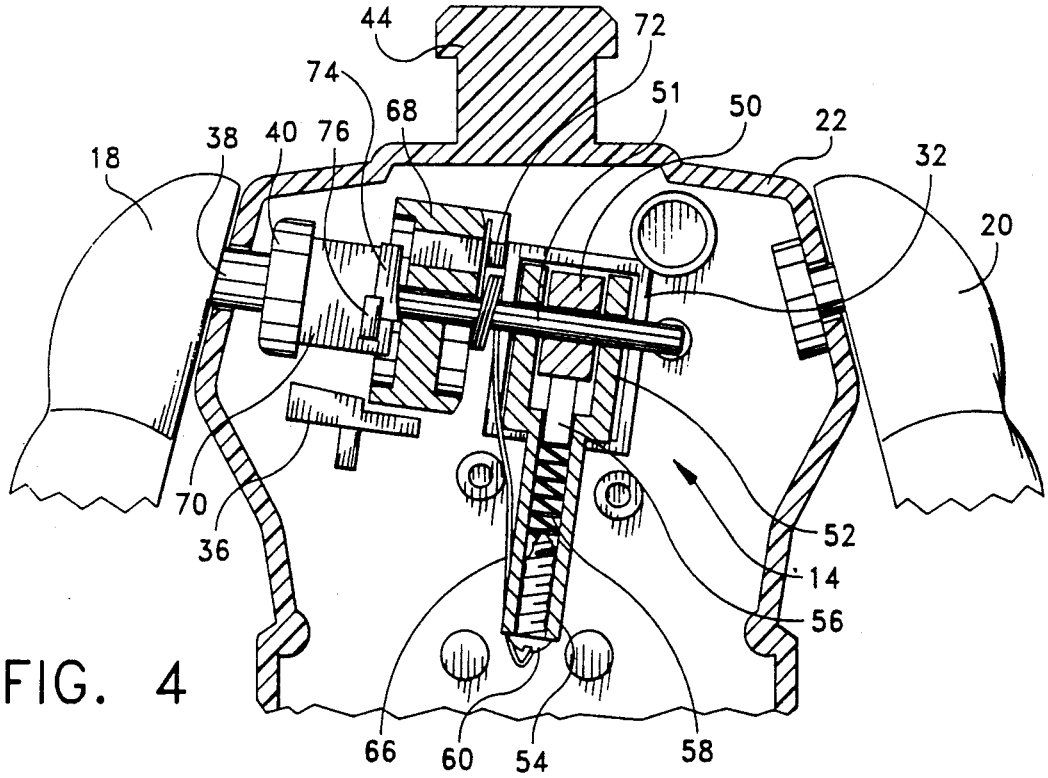
FIG. 4 is an enlarged fragmentary front sectional view of the torso portion and the sparking mechanism.
Figure 5:
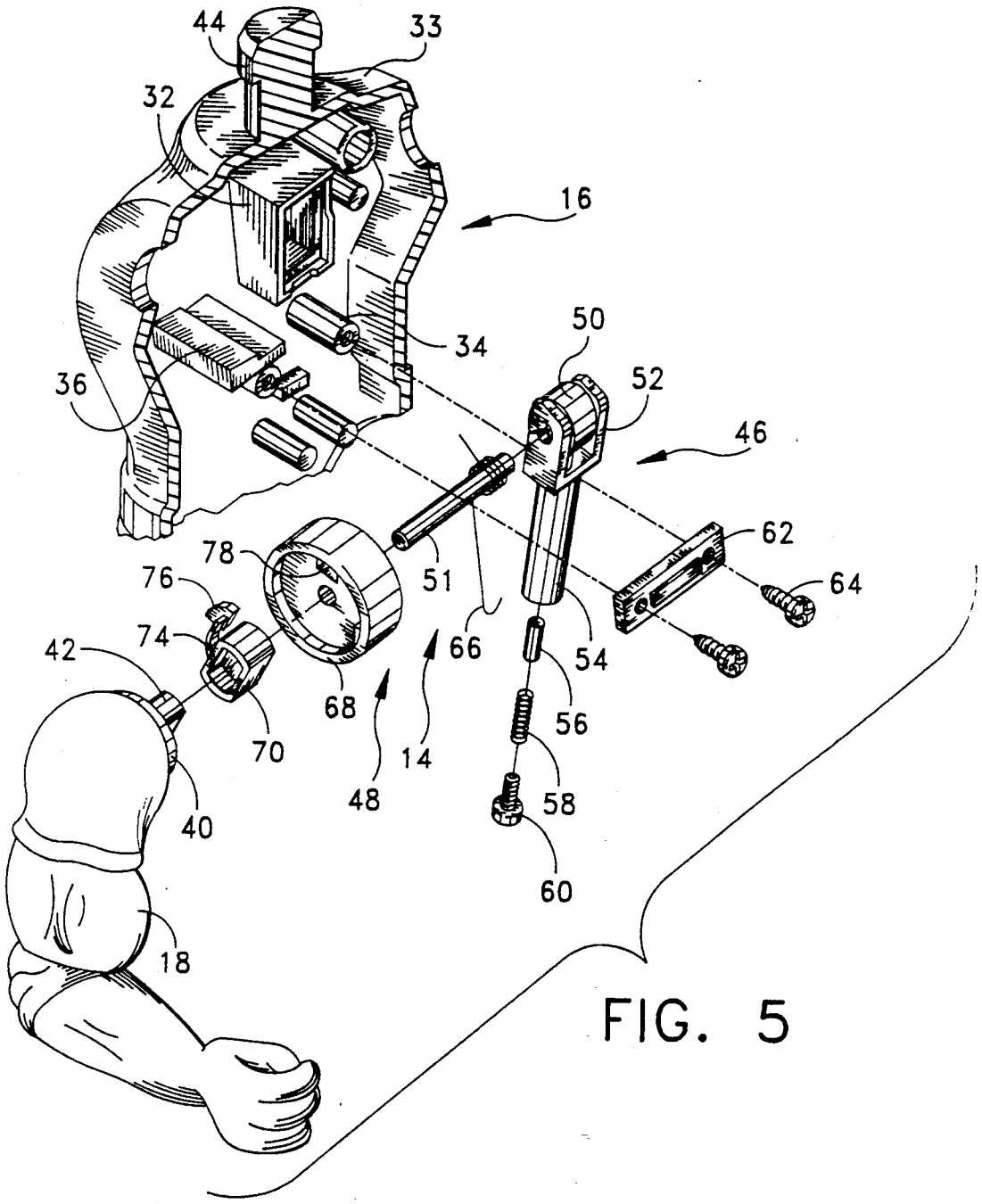
FIG. 5 is another exploded perspective view of the torso portion, right arm and sparking mechanism.

The sparking mechanism 14 is mounted in the interior of the torso portion 16, and it is illustrated in FIG. 3 through 5. The sparking mechanism 14 comprises a flint wheel assembly generally indicated at 46 and an actuator assembly 48 which is operative for actuating the flint wheel assembly 46 to produce sparks. The flint wheel assembly 46 comprises a flint wheel 50 having a knurled circumferential surface. The flint wheel 50 is nonrotatably received on a shaft 51 which is rotatably received in a mounting frame 52. Extending downwardly from the mounting frame 52 is a flint tube 54 which is open at the upper end thereof and a flint 56 of conventional construction is received in the flint tube 54 so that it extends upwardly into the mounting frame 52. A coil spring 58 is operative for biasing the flint 56 to a position of engagement with the circumferential surface of the flint wheel 50 and a screw 60 is threadedly received in the lower end of the flint tube 54 for maintaining the spring 58 in a compressed disposition. The flint wheel assembly 46 is received in the torso portion 16 so that the mounting frame 52 is received in the mounting frame portion 32, and a mounting plate 62 and screws 64 are provided for securing the flint wheel assembly 46 in the mounting frame 32.

The actuator assembly 48 comprises a torsion spring 66 which is received on the shaft 51, an actuator wheel 68 and an actuator member 70. The actuator wheel 68 is also nonrotatably received on the shaft 51 and the torsion spring 66 engages both the inner side of the rear torso portion half 22 and a lug 72 on the actuator wheel 68 to bias the actuator wheel 68 toward a predetermined first or nonrotated position. However, the actuator wheel 68 is rotatable against the bias of the spring 66 for operating the flint wheel assembly 46 to produce sparks with the flint 56. In this regard, the actuator member 70 is rotatably received on the shaft 51, and the square inner shaft portion 42 of the arm 18 is received in the actuator member 70 so that the actuator member 70 is rotated with the arm 18. The actuator member 70 includes a resilient arm 74 having a cam 76 thereon. The actuator member 70 is positioned so that when the arm 18 is pivoted from the upwardly extending first position illustrated in FIG. 1 to the downwardly extending second position illustrated in FIG. 2, the inner portions of the resilient arm 74 engage a latch 78 in the interior of the actuator wheel 68. As a result, the actuator arm 74 is initially operative for rotating the actuator wheel 68 as the arm 18 is pivoted downwardly and forwardly. Further, since the actuator wheel 68 is nonrotatably received on the shaft 51 the arm 18 and the actuator member 70 cooperate for rotating the flint wheel 50 as the arm 18 is pivoted forwardly and downwardly. However, as the arm 18 is pivoted further forwardly and downwardly in this manner, the cam 76 eventually engages the cam wall 36 to deflect the actuator arm 74 inwardly so that it is disengaged from the latch 78. Accordingly, when the arm 18 reaches a predetermined partially rotated position between the first position illustrated in FIG. 1 and the second position illustrated in FIG. 2, the actuator arm 74 is disengaged from the actuator wheel 68 so that torsion spring 66 causes the actuator wheel 68, the shaft 51, and the flint wheel 50 to be .rapidly rotated in a reverse direction back to their initial positions when the arm 18 was in the first position thereof. When this occurs, the flint 56, which is biased to a position of engagement with the knurled outer surface of the flint wheel 50, cooperates with the flint wheel 50 to produce sparks in the interior of the torso portion 16. These sparks are clearly visible through the window 30 in the aperture 28 in the front torso portion half 21 so that the window 30 is illuminated by the sparks.

It is seen therefore, that the instant invention provides an effective action character figure which is operative with a sparking effect to increase the play value of the character FIG. 10. Specifically, by rotating the right arm 18 from the upwardly extending first position illustrated in FIG. 1 to the downwardly extending second position illustrated in FIG. 2, the actuator wheel assembly 48 is operated for first rotating the flint wheel 50 in a corresponding direction against the bias of the spring 66 and for then releasing the flint wheel 50 so that it is rapidly rotated in a reverse direction by the torsion spring 66. This action is operative for reliably and effectively producing sparks with the flint 56, which sparks are clearly visible through the window 30. Hence, the action character figure can be effectively incorporated into a variety of play themes including those which relate to an action character figure having supernatural powers. Accordingly, it is seen that the action character figure of the instant invention represents a significant advancement in the toy art which has a high level of commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. An action character figure comprising;

(a) a character figure body portion including a torso portion having an aperture therein and a limb on said torso portion moveable between first and second positions thereon; and (b) sparking means in said torso portion for producing sparks therein, said sparking means being positioned in said torso portion so that said sparks are visible through said aperture, said sparking means including a flint, a flint wheel engaging said flint, and means for rotating said flint wheel at a sufficiently rapid rate to produce sparks therefrom, said means for rotating said flint wheel being operable by rotating said limb at a first rate to cause rotation of said flint wheel at an increased second rate which is sufficiently rapid to produce sparks from said flint.

2. In the action character figure of claim 1, said limb comprising an arm of said character figure, said arm being rotatable between said first and second positions for causing said sparking means to produce said sparks.

3. In the action character figure of claim 1, said torso portion including a chest portion, said aperture being located in said chest portion.

4. The action character figure of claim 3 further comprising a translucent window in said aperture.

5. In the action character figure of claim 2, said arm extending upwardly from said torso portion when said arm is in the first position thereof and extending downwardly from said torso portion when said arm is in the second position thereof.

6. In the action character figure of claim 5, said arm pivoting forwardly and downwardly from said first position thereof to said second position thereof for operating said sparking means.

7. An action character figure comprising;

(a) a character figure body portion including a torso portion having an aperture therein and a limb on said torso portion moveable between first and second positions thereon; and (b) sparking means in said torso portion including a flint, a flint wheel engaging said flint, a spring and means operatively connecting said flint wheel to said limb so that rotation of said limb in a first direction of rotation from the first position thereof to the second position thereof causes said spring to be loaded and then automatically released to cause said flint wheel to be rotated by said spring in an opposite second direction of rotation at a rate which is sufficiently rapid to produce sparks from said flint, said sparking means being positioned in said torso portion so that said sparks are visible through said aperture.

* * * * *